US005945787A

United States Patent [19]

Gorille et al.

[11] Patent Number: 5,945,787

[45] Date of Patent: Aug. 31, 1999

[54] POWER CONTROL OF AN AC-OPERATED HIGH-PRESSURE GAS DISCHARGE LAMP, PARTICULARLY FOR MOTOR VEHICLES

[75] Inventors: Ingo Gorille, Oberriexingen; Bernd Mueller, Reutlingen, both of Germany

[73] Assignee: Robert Bosch GmbH, Stuttgart, Germany

[21] Appl. No.: 08/952,169

[22] PCT Filed: Mar. 5, 1997

[86] PCT No.: PCT/DE97/00421

§ 371 Date: Nov. 6, 1997

§ 102(e) Date: Nov. 6, 1997

[87] PCT Pub. No.: WO97/33453

PCT Pub. Date: Sep. 12, 1997

[30] Foreign Application Priority Data

Mar. 6, 1996 [DE] Germany ..... 196 08 655

[51] Int. Cl.[6] ..... G05F 1/00

[52] U.S. Cl. ..... 315/307; 315/291; 315/224; 315/DIG. 2; 315/DIG. 7

[58] Field of Search ..... 315/307, 308, 315/291, 246, 244, 287, 224, 209 R, 205, DIG. 2, DIG. 7

[56] References Cited

U.S. PATENT DOCUMENTS

| | | | |
|---|---|---|---|
| 4,904,905 | 2/1990 | Olon | 315/244 |
| 5,349,273 | 9/1994 | Pacholok | 315/307 |
| 5,469,027 | 11/1995 | Uchihashi et al. | 315/224 |
| 5,481,162 | 1/1996 | Boenigk et al. | 315/307 |
| 5,677,602 | 10/1997 | Paul et al. | 315/224 |

FOREIGN PATENT DOCUMENTS

| | | |
|---|---|---|
| 0104264 | 4/1984 | European Pat. Off. . |
| 0440244 | 8/1991 | European Pat. Off. . |
| 3312574 | 10/1984 | Germany . |
| 3729383 | 3/1989 | Germany . |
| 4222634 | 1/1994 | Germany . |
| 94 08 734 U | 10/1994 | Germany . |
| 4314584 | 11/1994 | Germany . |

*Primary Examiner*—Don Wong
*Assistant Examiner*—Haissa Philogene
*Attorney, Agent, or Firm*—Venable; George H. Spencer

[57] ABSTRACT

A power control of an AC-operated, high-pressure gas discharge lamp, particularly in a motor vehicle, including a bridge circuit in which two controlled switching transistors are disposed in at least one branch, and in which the high-pressure gas discharge lamp is supplied with ignition and/or burning energy by way of the bridge branch provides that the switching transistors switch the current in the form of pulse packets, with the individual pulse packets respectively containing a certain number of high-frequency pulses; switching is effected with as little loss as possible in the zero crossings of the current; and regulation for maintaining a certain power of the high-pressure gas discharge lamp is effected through continuous averaging over a predetermined interval (44, 45) of the supplied power packets.

8 Claims, 4 Drawing Sheets

POWER CONTROL OF AN AC-OPERATED HIGH-PRESSURE GAS DISCHARGE LAMP, PARTICULARLY FOR MOTOR VEHICLES

STATE OF THE TECHNOLOGY

The invention is based on a power control of an AC-operated, high-pressure gas discharge lamp, particularly for motor vehicles, of the generic type defined in the preamble to claim 1.

DE 37 29 383 A1 discloses a circuit arrangement for operating a high-pressure gas discharge lamp that includes a bridge circuit, in which two controlled switching transistors are disposed in at least one branch, and in which the high-pressure gas discharge lamp is supplied with ignition and burning energy by way of the bridge branch of the bridge circuit.

In this known circuit arrangement, the high-pressure gas discharge lamp is disposed directly in the bridge branch of a bridge circuit configured as a capacitive half-bridge, with a throttle coil further being disposed in series with the lamp. Moreover, the secondary winding of an ignition transformer is provided in series with this arrangement. The supply current of the lamp, and thus the power control, is regulated by changes in the duty cycle of the switching transistors. At the start, the duty cycle is changed in a specific manner. The pulse-sequence frequency of the AC-type, bi-polar supply-current pulses is about 300 Hz in sodium discharge lamps, for example, and is superposed with a higher-frequency voltage between 30 and 70 kHz. The starting duty cycle is set at about 0.7, and the operating duty cycle is set at about 0.5.

It cannot be inferred from this known circuit arrangement whether, on the one hand, it is or can be used for starting and operating high-pressure gas discharge lamps such as those that can be installed into motor vehicles and are supplied with low voltage values, e.g. 6 or 12 Volts, from the onboard DC-voltage electrical system. On the other hand, the power control of this known circuit arrangement operates according to a different principle, and is not as low-loss as is necessary.

Applicant markets high-pressure gas discharge lamps under the name "Litronic." These lamps, which are used in motor vehicles, operate according to two different principles. According to the one principle, both start and operation are executed in so-called resonance operation. The starting frequency, that is, the frequency during lamp ignition, is about 80 kHz, and the burning frequency is about 8 to 16 kHz. According to the other principle, the lamp is operated in so-called free-wheeling DC operation, that is, the direct current changes poles again and again. The pole-reversal frequency is about 400 Hz. The lamp is ignited by way of a separate pulse igniter. The lamps used here are so-called xenon lamps or metal-halogenide lamps whose high pressure is about 80 bar. To ignite the light arc, a high voltage of 24 kV is necessary with regard to the poorest tolerance conditions. In burning operation, the necessary voltage is about 85 Volts.

Fundamental disadvantages associated with these two principles are that relatively numerous components and a special ignition device are necessary and, furthermore, that the components are rather large and must be resistant to high voltages. The disadvantages of this include relatively high costs, fairly high power losses and a considerable space requirement.

ADVANTAGES OF THE INVENTION

In contrast, the power control of the invention for an AC-operated, high-pressure gas discharge lamp, particularly for motor vehicles, having the characterizing features of claim 1, has the advantage of simple and economical power control that is loss-free up to the internal switching losses in the switching transistors. This is particularly essential for avoiding operation-stipulated switching losses in high-frequency operation of the switching transistors, as well as with respect to use in motor vehicles for preserving the battery capacity.

In accordance with the invention, this is basically achieved in that the switching transistors switch the current in the form of pulse packets, with the individual pulse packets respectively containing a specific number of high-frequency pulses; that switching is effected with the lowest possible losses in the zero crossings of the current; and that the regulation for maintaining a certain power of the high-pressure gas discharge lamp is effected by continuous averaging over a predetermined interval of the supplied power packets.

Advantageous modifications of and improvements to the power control disclosed in claim 1 are possible with the measures outlined in the further claims.

In accordance with a particularly advantageous embodiment of the invention, the continuous averaging is effected through incremental addition or omission of discrete, supplied power packets.

In a useful embodiment of the invention, the continuous averaging is effected through incremental addition or omission of discrete half-waves or pulses within consecutive, supplied pulse packets.

In a useful modification of the power control of the invention, supplied power packets are added or omitted by means of counting the zero crossings of the current using a digital control. According to a particularly advantageous embodiment of the invention, the digital control includes tables that contain the control and regulation values. This variation of the control is particularly favorable with respect to the use of the power control of the invention in a motor vehicle, because regulations can be embodied robustly and effected easily with tables and counting processes.

In accordance with an advantageous modification of the invention, switching transistors having extremely short switching times, that is, short rise and fall times, particularly MOSFET transistors, are used to further reduce the power loss.

A particularly useful modification of the invention provides that it is used in a circuit for operating a high-pressure gas discharge lamp, with the primary winding of a transformer being disposed in the bridge branch of a bridge circuit, and a coil being connected in series with this primary winding and a capacitor being provided in parallel to the primary winding and in series with the coil; as a result, a series-resonant converter having a primary-side resonant circuit is formed, the high-pressure gas discharge lamp is disposed in series with the secondary winding of the transformer and supplied with burning energy by the winding, and burning operation is effected at a high frequency. This type of circuit is described in Applicant's application "Schaltung zum Betrieb einer Hochdruckgasentladungslampe [Circuit for Operating a High-Pressure Gas Discharge Lamp]" >>EM 1298/94<< (simultaneously filed with the present application).

A further, particularly useful modification of the invention provides that it is used in a circuit arrangement for operating a high-pressure gas discharge lamp, with the primary winding of a transformer being disposed in the bridge branch of a bridge circuit, an oscillating circuit being disposed on the secondary side of the transformer, the high-pressure gas discharge lamp being supplied with burning and ignition energy by the secondary-side oscillating circuit, and both the burning operation and ignition process being effected at a high frequency, the ignition frequency being selected to be significantly higher than the burning-operation frequency. This type of circuit arrangement is described in Applicant's application "Schaltungsanordnung zum Betrieb einer Hochdruckgasentladungslampe [Circuit Arrangement for Operating a High-Pressure Gas Discharge Lamp]" >>EM 1108/94<< (simultaneously filed with the present application).

DRAWINGS

The invention is described in detail in the following description by way of embodiments illustrated in the drawings. Shown are in:

FIG. 1 schematically, a block diagram of a first circuit arrangement for operating a high-pressure gas discharge lamp, with the provision of a capacitive half-bridge in which the power control of the invention can be used;

FIG. 2 schematically, a block diagram of a second circuit for operating a high-pressure gas discharge lamp, with the provision of a full bridge in which the power control of the invention can be used;

FIG. 3 schematically, a diagram for defining the power packets in the power control of the invention;

FIG. 4 schematically, a diagram illustrating the case in which the power control of the invention is used with increasing power; and FIG. 5 schematically, a diagram illustrating the case in which the power control of the invention is used with decreasing power.

DESCRIPTION OF THE EMBODIMENTS

Figure 1:
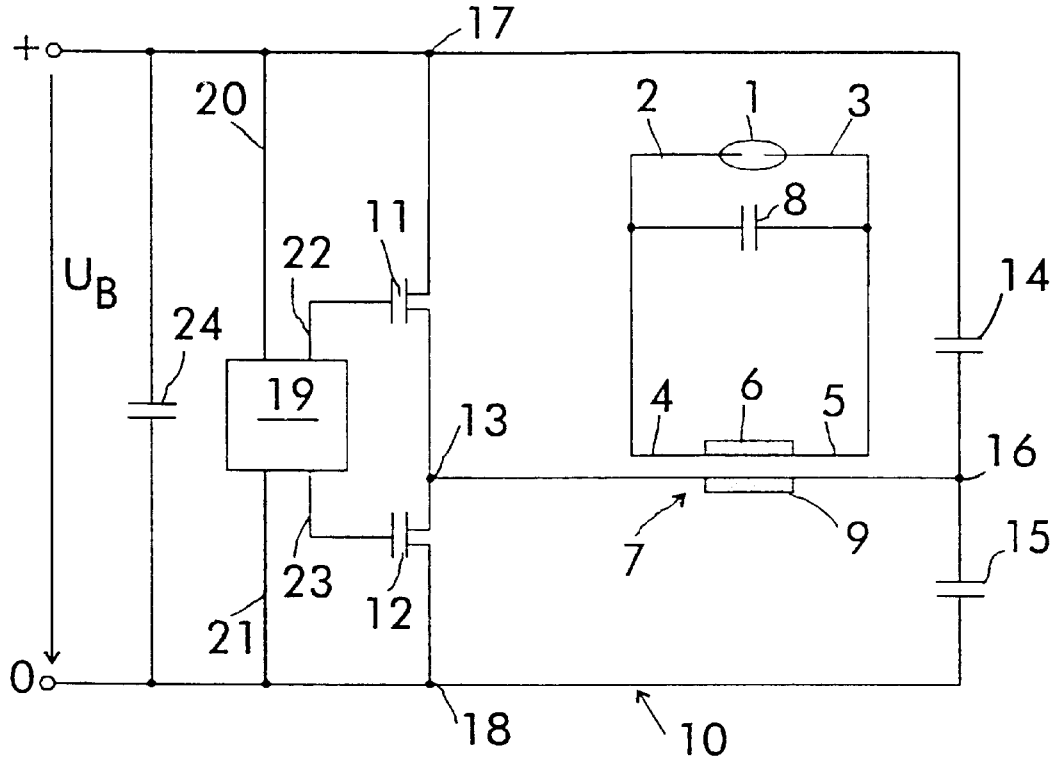

FIG. 1 schematically shows a block diagram of a first circuit arrangement for operating and starting a high-pressure gas discharge lamp in which the power control of the invention can be used advantageously. A high-pressure gas discharge lamp 1 is connected by its electrodes 2 and 3 to the two ends 4 and 5 of the secondary winding 6 of a transformer 7. Between the electrodes 2 and 3, a capacitor 8 is switched in parallel to the high-pressure gas discharge lamp 1. On the secondary side of the transformer 7, its capacitor 8 and the secondary winding 6 form an oscillating circuit that is used to supply the high-pressure gas discharge lamp 1 with burning and ignition energy.

The primary winding 9 of the transformer 7 is disposed in the bridge branch of a bridge circuit 10. The illustrated bridge circuit 10 is a so-called capacitive half-bridge in which two controlled switching transistors 11 and 12 are disposed in a branch, here the left one. The connecting point 13 of the two transistors 11 and 12 forms a connection of the bridge branch. Two capacitors 14 and 15 are disposed in the other branch, here the right one. The connecting point 16 of the two capacitors 14 and 15 forms the connection of the bridge branch. The aforementioned primary winding 9 of the transformer 7 is disposed in this bridge branch, between the connections 13 and 16. The switching transistor 11 and the capacitor 14 are connected to one another at the connection 17, as well as to the positive pole + of a supply-voltage source, for example the battery of a motor vehicle. The switching transistor 12 and the capacitor 15 are connected to one another at the connection 18, as well as to the ground potential 0 of the supply-voltage source.

The battery voltage $U_B$ is applied between the positive pole + and the ground potential 0. A microcontroller 19 is connected by its connections 20 and 21 to the positive pole + or ground potential 0 of the supply voltage $U_B$. Control outputs 22 and 23 of the microcontroller 19 are guided to the control inputs of the associated, controlled switching transistors 11 and 12, respectively. A transverse capacitor 24 is provided for avoiding high-frequency scatter into the onboard electrical system via the connections + and 0.

Figure 2:
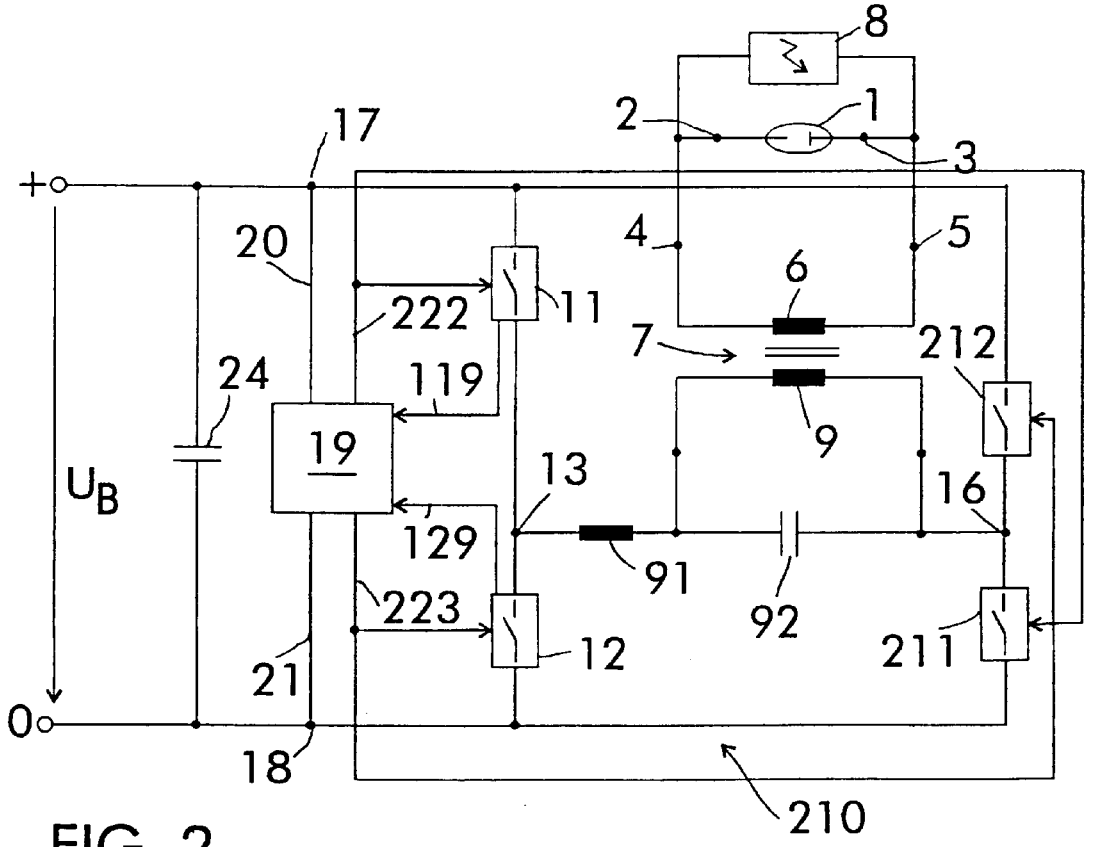

FIG. 2 shows a second circuit in which the power control of the invention can be used advantageously. In place of the two bridge capacitors 14 and 15, the so-called full-bridge circuit 210 illustrated in the embodiment of FIG. 2 includes two switching transistors 212 and 211 that are used as switches. Control lines 222 and 223 of the microcontroller 19 are guided to the control inputs of the switching transistors 11 and 211 and 12 and 212, respectively, in order to switch them to conduct or block crosswise. Otherwise, this embodiment corresponds to the one shown and described in conjunction with FIG. 1.

In the embodiment according to FIG. 2, a sensing line 119 for the current in the switching transistor 11 is provided between the switching transistor 11 and the microcontroller 19, and a sensing line 129 for the current in the switching transistor 12 is provided between the switching transistor 12 and the microcontroller 19. In particular, these sensing lines detect the zero crossing in the switching transistor.

The power of the high-pressure gas discharge lamp 1 is advantageously regulated by means of pulse-packet control corresponding to the power control of the invention. The change in power is effected by a change in the number of discrete pulses contained in the respective pulse packet. The switching of the switching transistors 11 and 12 or 11 with 211 and 12 with 212 corresponds to the respective envelope or respective size of the pulse packets. Furthermore, the current is respectively switched by the switching transistors in the zero crossing of the current. These zero crossings of the current are determined on the sensing lines 119 and 129 of the microcontroller 19.

Figure 3:
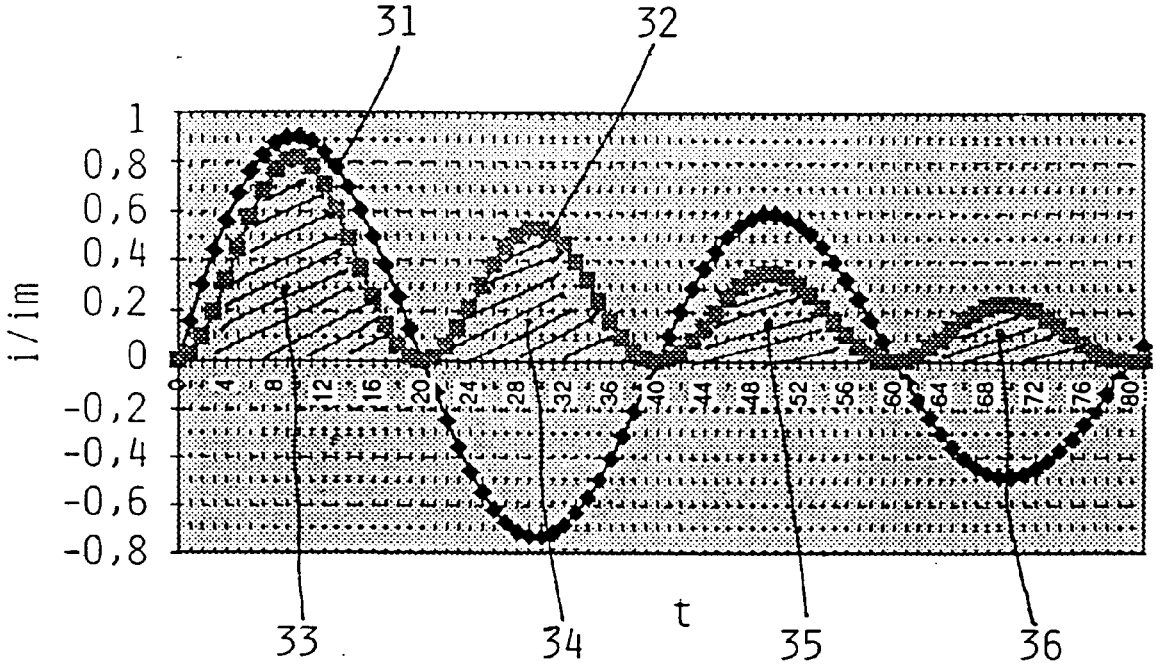

To define the power packets, the current path is shown as the curve 31 over the time axis t in the diagram of FIG. 3, namely normalized as I/Im, in which the current I is related to the maximum current Im. The squared current, and therefore the power, is illustrated by the curve 32. The numbers and the associated division on the time axis t stand for the number of half-waves of the high-frequency pulses contained in the pulse packets.

The instantaneous power in the case of decaying oscillation essentially follows a course as shown by way of example in the diagram of FIG. 3. If, as provided by the invention, switching only occurs in the zero crossing of the current, energy or power packets 33, 34, 35, 36 of differing sizes result; these correspond to the respective cross-hatched surfaces between the time axis t and beneath the positive arcs of the power curve 32.

In the illustrated example of power that is decreasing, that is, the case of decay, the power packets 33, 34, 35, 36 decrease steadily in size. The numbers 0 through 80 shown on the time axis represent the number of half-oscillations.

Figure 4:
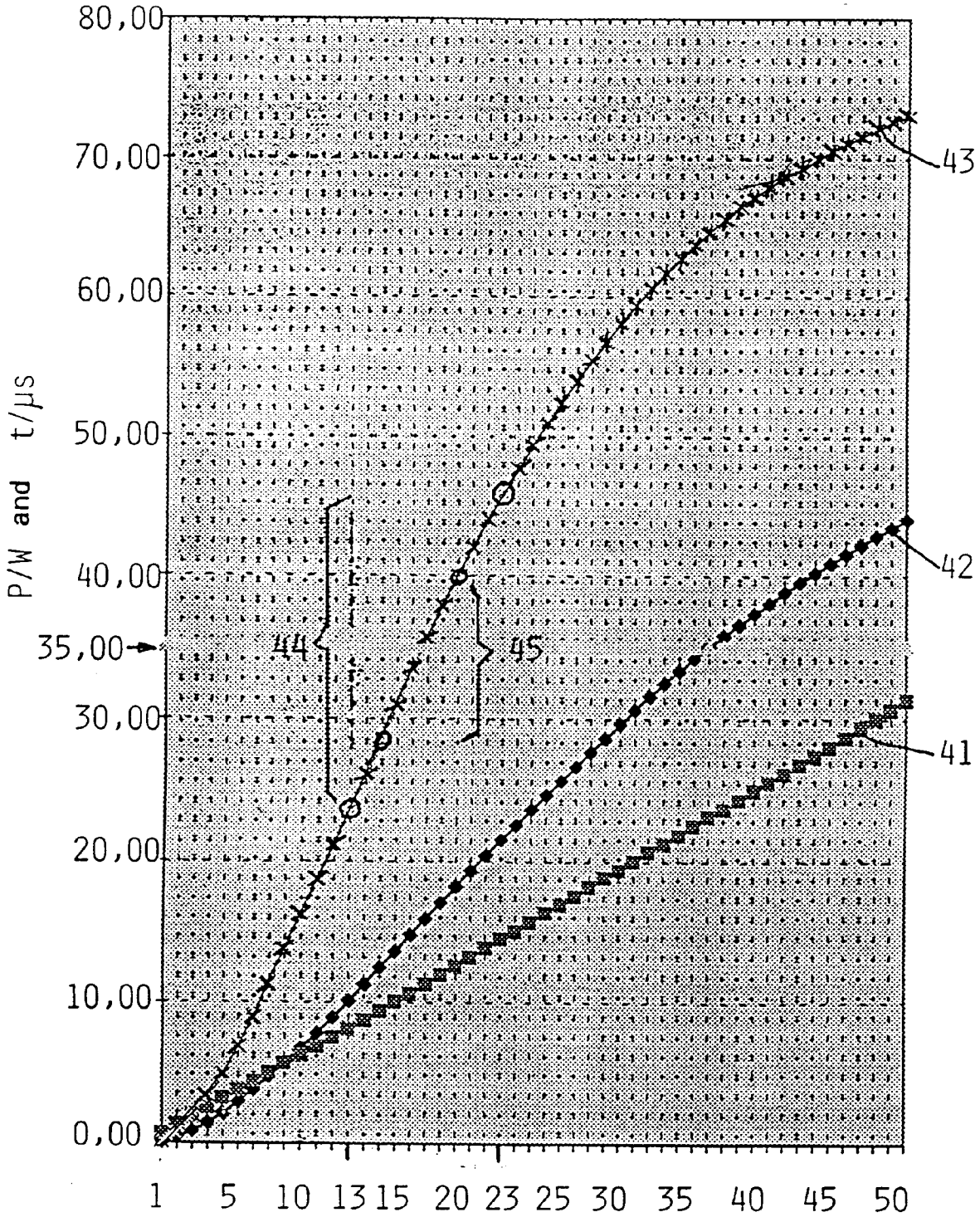
Figure 5:
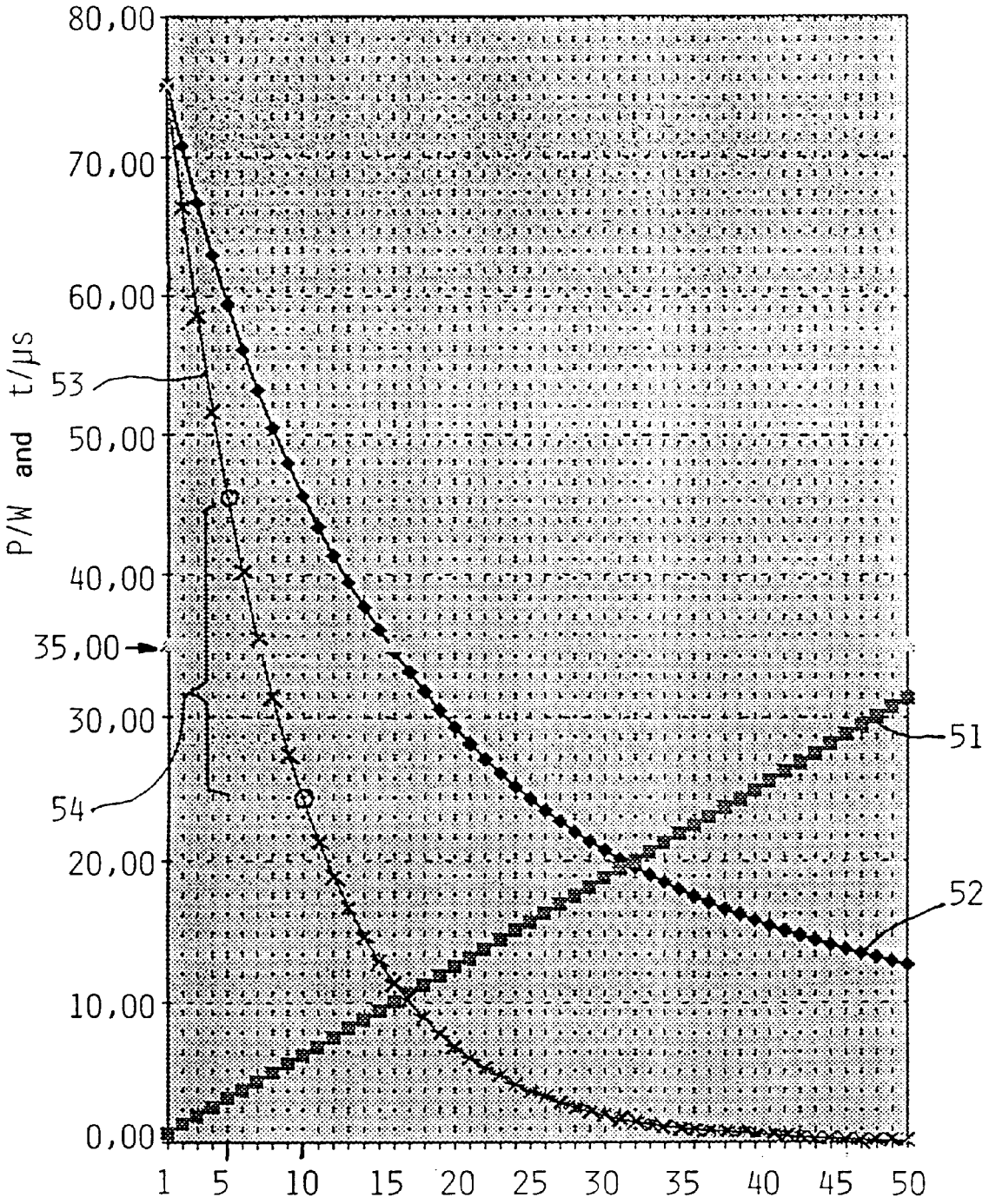

The power control of the invention provides averaging over a plurality of power packets for regulating the power at a specific nominal value, for example an average value of 35 W in FIGS. 4 and 5. This means that the individual power packets differ slightly from one another in size, but make available the desired power in the averaging. It can also be said that a constant change occurs between rising power, that is, power that is building up, and power that is decreasing or decaying. Building up and decaying oscillations are constantly present, albeit not of the same size, corresponding to the magnitudes of powers that are quantized in small jumps. Because switching only occurs in the zero crossing, a full half-oscillation of the high-frequency current represents the smallest quantum. The advantage of this lies in the fact that the power packets are not identical in magnitude, but can be calculated unequivocally. Regulation at a specific value is effected by continuous averaging over a predetermined interval through incremental addition or omission of discrete power packets.

The diagram in FIG. 4 clarifies the range in which the interval can be selected if the power is building up. The number of half-oscillations that can be contained in pulse packets is shown on the horizontal axis. On the vertical axis, the power P is shown in W and the time t is shown in $\mu$s. The curve 41, which increases in steps in linear fashion, indicates the course of time. The curve 42 represents the maximum power, and the curve 43 represents the packet power. A possible nominal value of 35 W, at which the power can be regulated, is specially indicated. To attain this nominal value, continuous averaging takes place in a certain interval 44. The power packets contain between 13 and 23 half-waves. A further example, with a shorter interval 45, is also shown. In this interval 45, the number of half-oscillations contained in the power packets is between 15 and 20. The individual power packets having the corresponding, discrete numbers of half-oscillations are indicated by crosses; the respective associated packet power is to be inferred from the vertical axis.

The diagram in FIG. 5 clarifies the range in which the interval can be selected if the power is decaying. The number of half-oscillations that can be contained in pulse packets is shown on the horizontal axis. The power P in W and the time t in $\mu$s are shown on the vertical axis. The curve 51, which increases in steps in linear fashion, indicates the course of time. The curve 52 represents the decaying maximum power, and the curve 53 represents the packet power. A possible nominal value of 35 W, at which the power can be regulated, is specially marked. To attain this nominal value, continuous averaging takes place in a certain interval 54. The individual power packets contain between 5 and 10 half-waves. The individual power packets having the corresponding, discrete numbers of half-oscillations are indicated by crosses; the respective associated packet power is to be inferred from the vertical axis.

The respective possible size of the interval 44 or 45 or 54, in which the continuous averaging takes place, is especially dependent on the quality of the circuit in which the control of the invention is used. High quality ensures better regulation options.

The power control of the invention can be configured robustly and effected simply by means of counting the zero crossings of the current and evaluating control and regulation values of a digital control that are stored in tables. Digital control of this type can be provided, for example, in the microcontroller 19 of the examples illustrated in FIGS. 1 and 2. The signals of the zero crossings of the current, which serve as reference and counting signals, are supplied to the microcontroller 19 via the lines 119 and 129 in FIG. 2.

To further reduce the power loss, which is particularly useful in high-frequency operation of the switching transistors, switching transistors are used that have extremely short switching times, that is, short rise and fall times. Such transistors can particularly be MOSFET transistors.

The power control of the invention permits simple, economical, very low-power-loss regulation of the power of a high-frequency circuit. When applied to the power control of a high-power gas discharge lamp, particularly one that is installed into a motor vehicle, this leads to a very economical solution that preserves the battery.

We claim:

1. Power control of an AC-operated, high-pressure gas discharge lamp (1), particularly in a motor vehicle, including a bridge circuit (10, 210), in which two controlled switching transistors (11, 12) are disposed in at least one branch, and in which the high-pressure gas discharge lamp (1) is supplied with ignition and/or burning energy by way of the bridge branch (13–16), characterized in that the switching transistors (11, 12 or 211, 212) switch the current in the form of pulse packets, with the individual pulse packets respectively containing a certain number of high-frequency pulses, switching is effected with as little loss as possible in the zero crossings of the current, and regulation for maintaining a certain power of the high-pressure gas discharge lamp (1) is effected through continuous averaging over a predetermined interval (44, 45 or 54) of power packets which are being supplied.

2. Power control according to claim 1, characterized in that the continuous averaging is effected through incremental addition or omission of discrete, supplied power packets.

3. Power control according to claim 1, characterized in that the continuous averaging is effected through incremental addition or omission of discrete half-waves or pulses in consecutive, supplied pulse packets.

4. Power control according to claim 1, characterized in that the addition or omission of supplied power packets is effected by means of counting the zero crossings of the current using a digital control (19).

5. Power control according to claim 4, characterized in that the digital control (19) includes tables that contain the control and regulation values.

6. Power control according to claim 1, characterized in that switching transistors (11, 12 or 211, 212) are used that have extremely short switching times, that is, short rise and fall times, particularly MOSFET transistors.

7. Power control according to claim 1, characterized in that it is used in a circuit for operating a high-pressure gas discharge lamp (1), in which the primary winding (9) of a transformer (7) is disposed in the bridge branch (13–16) of the bridge circuit (210), a coil (91) is provided in series with this primary winding (9), and a capacitor (92) is provided in parallel to the primary winding (9) and in series with the coil (91), thus forming a series-resonant converter having a primary-side resonant circuit, and the high-pressure gas discharge lamp (1) is disposed in series with the secondary winding (6) of the transformer (7) and supplied with burning energy by the winding, and burning operation is effected at a high frequency.

8. Power control according to claim 1, characterized in that it is used in a circuit arrangement for operating a high-pressure gas discharge lamp (1) in which the primary winding (9) of a transformer (7) is disposed in the bridge branch (13–16) of the bridge circuit (10), an oscillating circuit (6, 8) is disposed on the secondary side (6) of the transformer (7), the high-pressure gas discharge lamp (1) is supplied with burning and ignition energy by the secondary-side oscillation circuit (6, 8), and both burning operation and the ignition process are effected at a high frequency, with the ignition frequency being selected to be significantly higher than the burning-operation frequency.

* * * * *